US012031406B2

(12) United States Patent
Cain et al.

(10) Patent No.: US 12,031,406 B2
(45) Date of Patent: Jul. 9, 2024

(54) HYDRAULIC ACCUMULATOR SYSTEM

(71) Applicant: Patriot Research Center, LLC, Houston, TX (US)

(72) Inventors: Brandon Cain, Houston, TX (US); Manish Agarwal, Cypress, TX (US); Craig Cotton, Cypress, TX (US); Joseph Opitz, Wellington, CO (US)

(73) Assignee: Patriot Research Center, LLC, Houston, TX (US)

( * ) Notice: Subject to any disclaimer, the term of this patent is extended or adjusted under 35 U.S.C. 154(b) by 0 days.

(21) Appl. No.: 17/084,220

(22) Filed: Oct. 29, 2020

(65) Prior Publication Data

US 2022/0136366 A1 May 5, 2022

(51) Int. Cl.

| | |
|---|---|
| ***E21B 34/02*** | (2006.01) |
| ***E21B 33/06*** | (2006.01) |
| ***E21B 34/16*** | (2006.01) |

(52) U.S. Cl.

CPC ..... *E21B 34/02* (2013.01); *E21B 33/06* (2013.01); *E21B 34/16* (2013.01)

(58) Field of Classification Search

None

See application file for complete search history.

(56) References Cited

U.S. PATENT DOCUMENTS

| | | | | |
|---|---|---|---|---|
| 2015/0345272 | A1* | 12/2015 | Kajaria | E21B 47/00 166/308.1 |
| 2020/0309319 | A1* | 10/2020 | Pitcher | F16N 7/38 |
| 2020/0355321 | A1* | 11/2020 | Zerkus | F16K 31/122 |
| 2021/0301638 | A1* | 9/2021 | Boyd | E21B 43/2607 |
| 2022/0186583 | A1* | 6/2022 | Cain | F16N 11/00 |
| 2022/0268141 | A1* | 8/2022 | Krupa | E21B 43/2607 |

* cited by examiner

*Primary Examiner* — Daphne M Barry

(74) *Attorney, Agent, or Firm* — Ramey LLP

(57) ABSTRACT

A hydraulic accumulator system is provided to remove the motors or engines from the red zone while maintaining sufficient capacity within the red zone to quickly close the designated blowout preventer or other gate valves. Additionally, a single point is provided outside of the red zone to charge the local storage units or to open or close the designated blowout preventer or other gate valves when time is not a critical consideration.

14 Claims, 4 Drawing Sheets

HYDRAULIC ACCUMULATOR SYSTEM

BACKGROUND

When drilling and completing an oil and gas well, at the surface is the equipment necessary to contain and control the pressure in downhole formations that may be penetrated by the drilling operation. Generally, a blowout preventer is attached to the uppermost tubular or casing that is cemented within the wellbore. In many instances other pieces of equipment are attached to the blowout preventer to facilitate moving the equipment into and out of the wellbore during the drilling and completion operations. For instance, during fracking operations various frac valves may be attached to the blowout preventer.

During drilling or completions, it is possible that uncontained pressure may be released into the casing, up the wellbore, and to the surface. In such an instance the blowout preventer and other valves may be closed to contain and control the pressure within the wellbore. In order to perform such an operation, the blowout preventer rams and/or the various valves on the surface must be able to close with sufficient force to shear through objects that may be within the blowout preventer. Additionally, the blow out preventor and other valves must be very fast and easy to close which in turn requires that a significant force must be almost instantly available to drive the rams in the blow out preventor and other valves home. Due to pressure losses incurred when using a long pipe or hose in comparison to the pipe or hose's diameter the high pressure source of hydraulic fluid must be relatively close to the valve actuators in order to close the valves quickly in case of emergency. Activating a hydraulic pump will provide sufficient pressure to close the blowout preventer and other valves however high pressure pumps are generally low-volume pumps and consequently require a significant amount of time to provide the amount of fluid at the pressure required to close the designated blowout preventer and other valves on a wellhead in an emergency. In order to provide the required force nearly instantaneously or at least as quickly as possible a hydropneumatic accumulator may be used.

Accumulated hydraulic energy is commonly used to provide sufficient power to quickly close the blowout preventor and various valves. The hydropneumatics accumulator may also be used as emergency power in case the supply from hydraulic pumps is lost. Such accumulators are often positioned locally on equipment which is to be operated, in order to provide quick response with the necessary capacity when hydraulic functions are activated. Generally, a hydropneumatic accumulator is a pressure vessel, in which liquid may be stored under pressure, with an enclosed pressurized gas volume that functions as a spring element. The accumulator is connected to a hydraulic system and when liquid is supplied to the accumulator, the gas volume is compressed by the liquid pressure rising. Thereby the accumulator can supply the system with liquid by the gas expanding as the system pressure decreases.

When a well is drilled a single well is drilled at a time. A typical hydropneumatic accumulator system currently used in fracking is the same hydropneumatic accumulator system used in drilling and therefore a single hydropneumatic accumulator system accommodates only a single wellbore and wellhead. However when fracking, usually multiple wells are fracked at the same time and unfortunately a hydropneumatic accumulator system is required for each well and wellhead and is dedicated to the blowout preventer and other valves on the single wellhead.

The typical hydropneumatic accumulator system is generally mounted on a skid and includes a power source. The power source is usually a small diesel engine but could be a gasoline engine or an electric motor. The power source in turn drives an air compressor. The air compressor supplies compressed air usually at about 150 psi. The compressed air in turn drives one or more air operated hydraulic pumps. The air operated hydraulic pumps use the compressed air at about 150 psi and provide hydraulic fluid pressurized at, usually at up to about 3000 psi. The hydraulic fluid in turn may be directed into a bank of high pressure cylinders. The high pressure cylinders usually have a certain amount of gas within the cylinders as the hydraulic fluid is directed into the highest pressure cylinders hydraulic fluid displaces and compresses the gas that is already present within each of the high pressure cylinders. The high pressure cylinders contain sufficient hydraulic fluid and pressurized gas to provide enough power to the various valve actuators on the blowout preventer and other valves to cycle the valves closed, then open, then closed. Once an appropriate amount of hydraulic fluid is present within the high pressure cylinders the system is placed on standby and the gas within each of the high pressure cylinders acts as a spring so that when required as the hydraulic fluid is directed to close the valves the high-pressure gas will force the hydraulic fluid out at pressure into the hydraulic actuators to close each of the valves as quickly as possible. Unfortunately with each system used the likelihood of failure on at least one of the systems increases. Additionally, there are significant safety issues involved by having an internal combustion engine or an electric motor within the red zone therefore when any well within the red zone is being fracked the current hydropneumatics accumulator must have their engines and motors off. The red zone is an exclusion zone around each wellhead and associated fracking systems. The red zone is kept free of people and explosion hazards due to the presence of flammable hydrocarbons and high pressure during fracking.

SUMMARY

In an in an effort to reduce cost and to increase the reliability of hydropneumatic accumulators for fracking the present invention has been envisioned. The system includes a relatively small high-pressure cylinder, referred to as the local storage. The local storage is small high-pressure cylinder having an about 11 gallon storage capacity and supplies high pressure hydraulic fluid, at least 1000 psi, to the blowout preventer valves, gate valves, and other valve closure mechanisms to cycle the valves from open to closed. The local storage is located within the red zone and is preferably located within 10 feet of the wellhead in order to reduce the length of the supply lines between the local storage and the various valve closure mechanisms. As the length of the lines between the local storage unit and the valve closure mechanisms increases the pressure available at the valve closure mechanism decreases due to boundary layer drag, the inertia of fluid in the line, and other issues related to forcing fluid at high speed through a relatively small diameter line when compared to the length. Generally, in the industry ⅜ inch inner diameter lines are used to connect the accumulators to the valve closure mechanisms.

While the local storage remains in the red zone the power and hydraulic supply, having a small engine or electric motor, at least one air compressor, and at least one air operated hydraulic pump has been moved out of the red zone. The single power and hydraulic supply is then connected to each of the local storage units. The single power and hydraulic supply is connected to each of the local storage units preferably by a manifold for the manifold has at least one input port and at least one output port. The manifold input port is connected to at least one of the air operated hydraulic pumps while the manifold at least one output port is connected to each of the local storage units. More preferably the manifold is located within the red zone and as close as practical to the various local storage units. With the manifold located within the red zone generally, a single line connects the air operated hydraulic pumps to the manifold in some instances such as when there is more than one air operated hydraulic pumps multiple lines may be connected to the input ports on the manifold. The single line connecting the air operated hydraulic pump to the manifold may have a larger diameter such as a ½ inch or larger inner diameter or may simply be a standard ⅜ inch inner diameter line. The manifold may have a valve connected to each output port between the local storage unit and the manifold in order to isolate any local storage unit or units.

When a local storage unit is used to quickly close a valve, usually the valve must be closed as quickly as possible. However, once the valve is quickly closed the operator has time to reopen the valve at their leisure. When the valve needs to be reopened the power and hydraulic supply may be actuated along with opening the appropriate valve between the manifold output and the local storage in order to resupply the specified local storage unit with pressurized hydraulic fluid allowing the valve to be reopened and reset for closure.

DETAILED DESCRIPTION

The description that follows includes exemplary apparatus, methods, techniques, or instruction sequences that embody techniques of the inventive subject matter. However, it is understood that the described embodiments may be practiced without these specific details. When referring to the top of the device or component top is towards the surface of the well. Side is radially offset from a component but minimally longitudinally offset.

Figure 1:
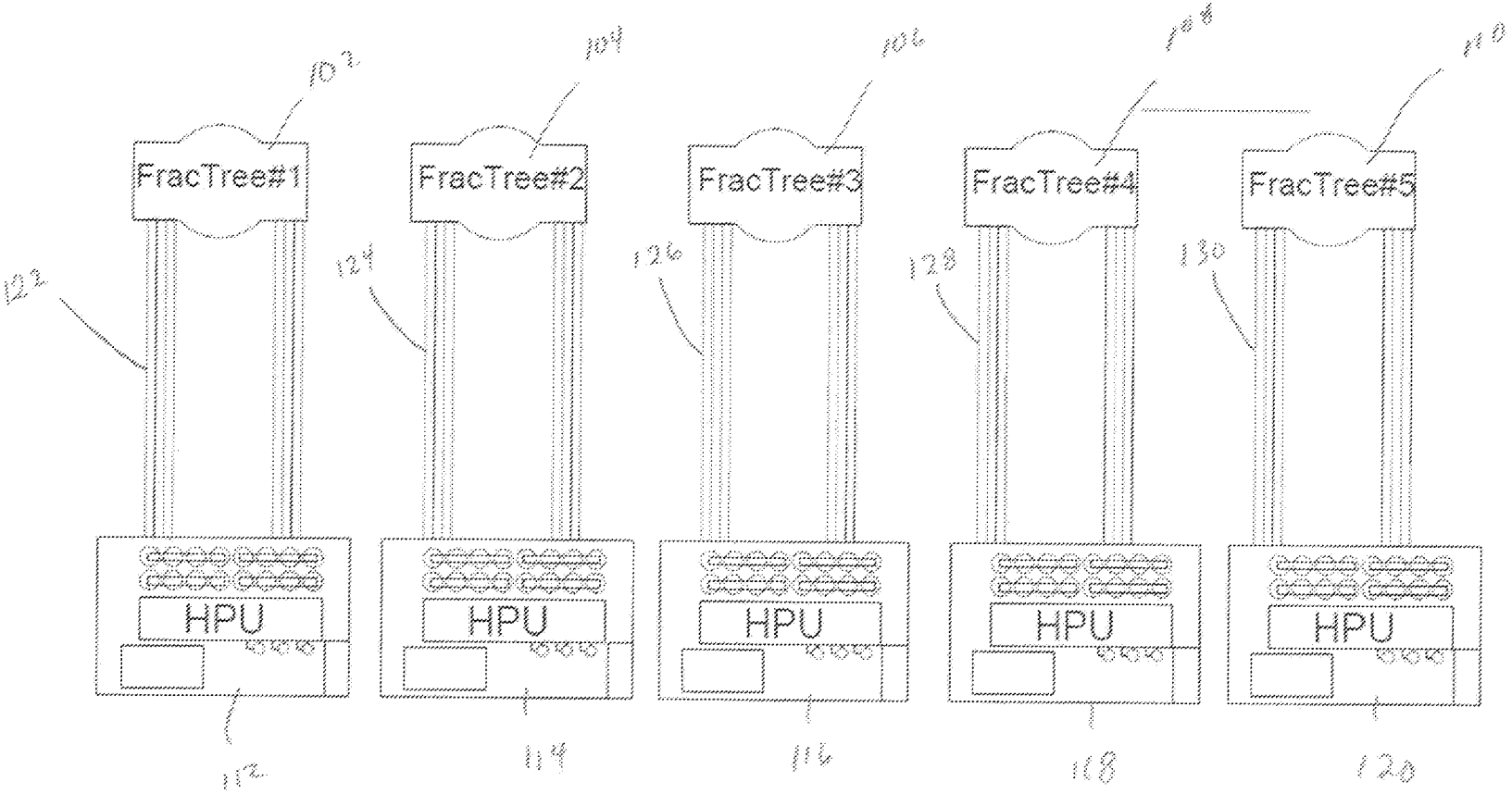
Fig. 1 Prior Art
FIG. 1 is a representation of a prior art hydraulic accumulator system.

FIG. 1 is a representation of a well pad 100 having 5 wellheads 102, 104, 106, 108, and 110 or frack tree's and a prior art hydraulic accumulator system 112, 114, 116, 118, and 120 for each of the 5 wellheads 102-110. Each of the hydraulic accumulator system 112 through 114 is coupled to a wellhead by hydraulic lines such as hydraulic lines 122 that couple hydraulic accumulator system 112 to frack tree 102, hydraulic lines 124 that couple hydraulic accumulator system 114 to frack tree 104, hydraulic lines 126 that couple hydraulic accumulator system 116 to frack tree 106, hydraulic lines 128 that couple hydraulic accumulator system 118 to frack tree 108 and, hydraulic lines 130 that couple hydraulic accumulator system 120 to frack tree 110. Each of the hydraulic accumulator systems 112-120 includes a hydraulic pump where the output of the hydraulic pump is connected to the hydraulic lines 122-130. Each of the wellheads 102-110 includes a blowout preventer or other gate valves. Each of the gate valves has a hydraulic actuator where each of the hydraulic actuators are connected in turn to hydraulic hose such as hoses 122-130. In turn the entire systems including wellheads 102-110, hydraulic accumulator systems 112-120, and hydraulic hoses 122-130 are located within the red zone.

Figure 2:
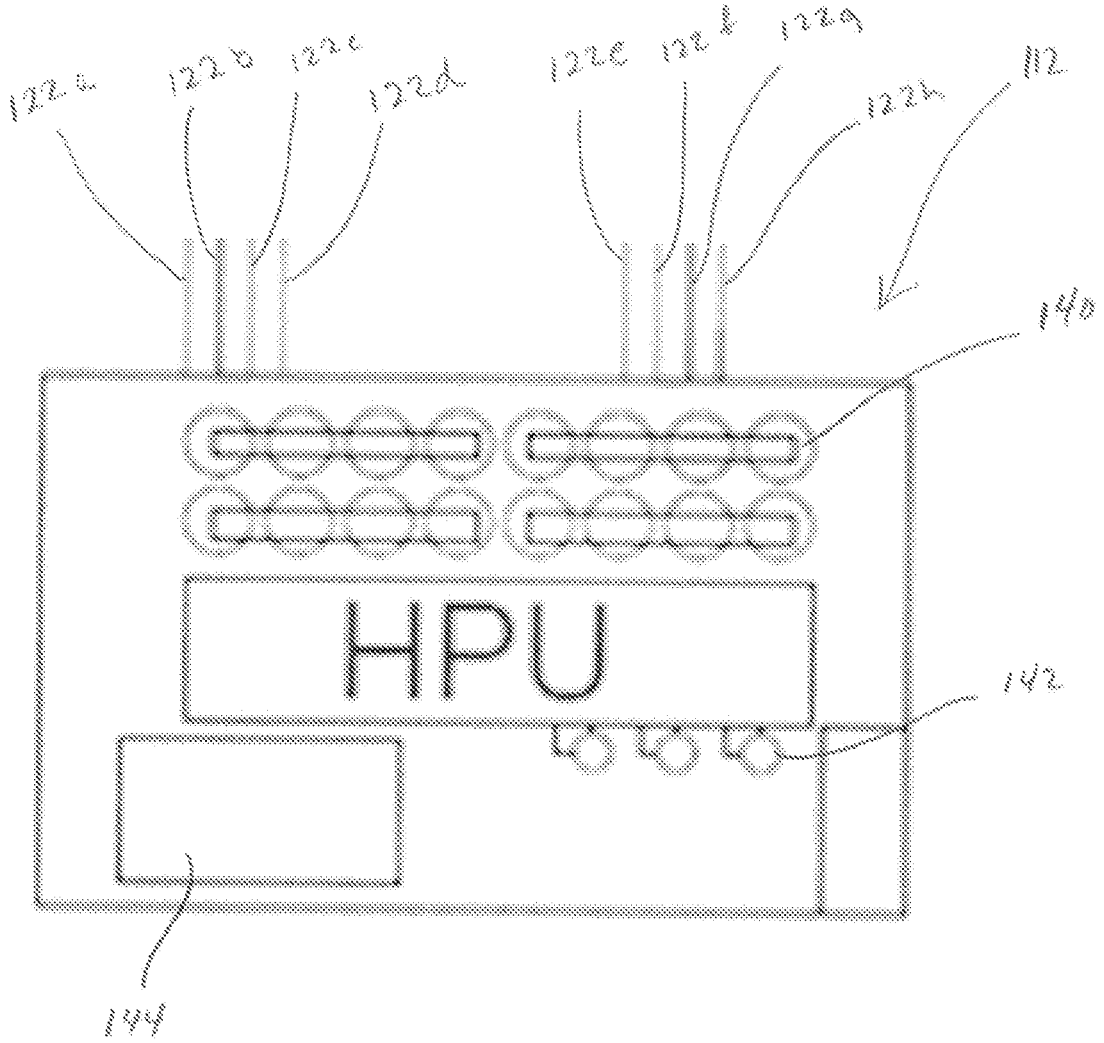
Fig 2 Prior Art
FIG. 2 is a representation of a prior art hydraulic accumulator.

FIG. 2 is a close-up of prior art hydraulic accumulator system 112. The hydraulic accumulator system 112 as shown includes hydraulic lines 122*a*-122*h*. Generally, each of the hydraulic lines 122 *a-h* is connected to an output of the accumulator bottles 140. The accumulator bottles 140 are connected to hydraulic pumps 142. In turn, the hydraulic pumps 142 are powered by engine or motor 144.

Figure 3:
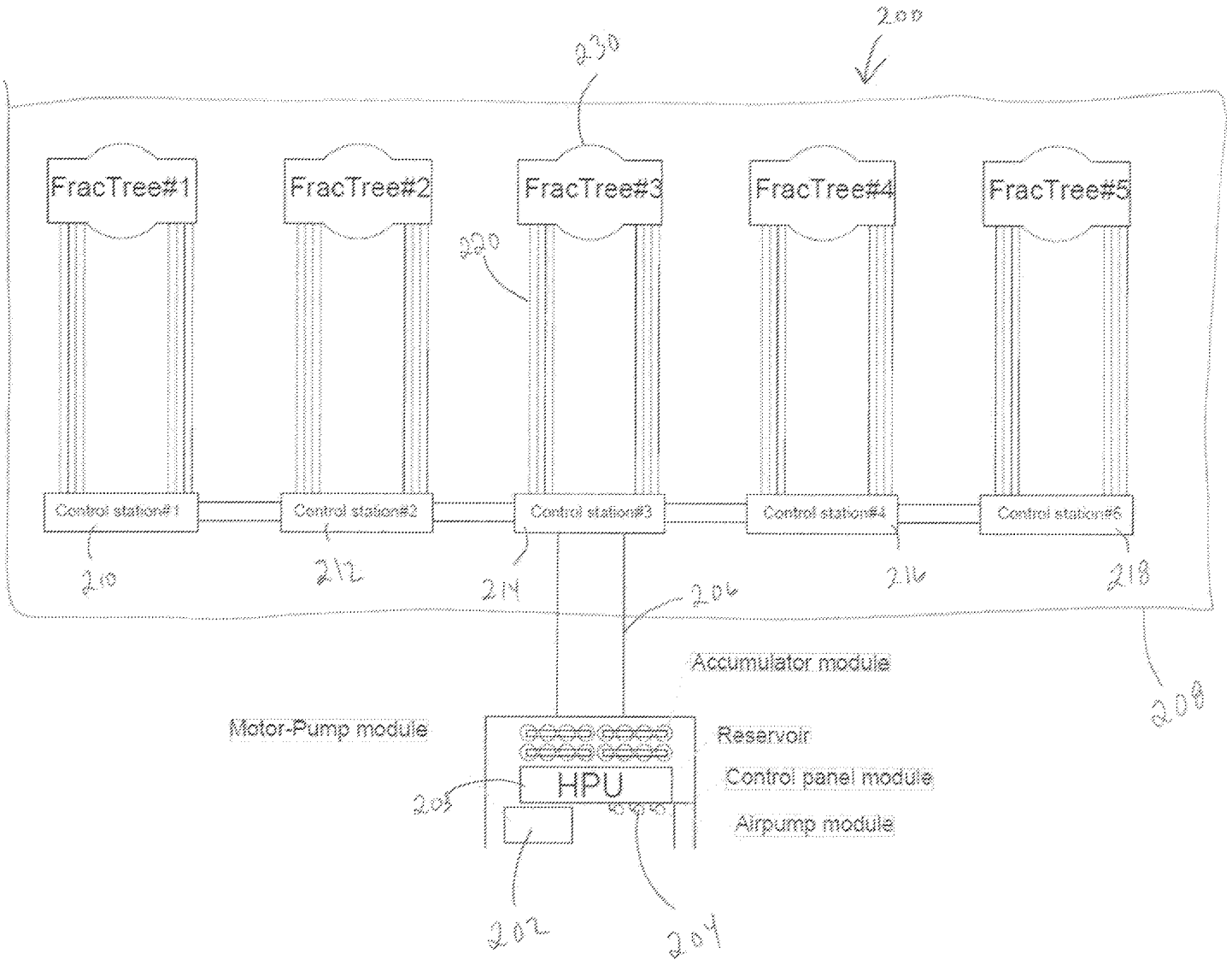
FIG. 3 provides an overview of an embodiment of the current hydraulic accumulator system.

FIG. 3 provides an overview of an embodiment of the current hydraulic accumulator system 200. The hydraulic accumulator system 200 has a single point where an engine or motor 202 actuates hydraulic pumps 204. The engine or motor 202, hydraulic pumps 204, and hydraulic reservoir 203 are located outside of the red zone 208. In turn the hydraulic pumps 204 are connected to at least one hydraulic line 206. Hydraulic line 206 is supplied with pressurized hydraulic fluid from outside of the red zone, crosses the red zone boundary, and supplies a tee, a manifold and/or control station within the red zone. Hydraulic line 206 may be connected to a manifold or simply a line tee where the manifold output or tees is directed to a local storage unit associated with a particular wellhead. As shown the hydraulic line 206 is linked to a control station, such as control station 210, 212, 214, 216, or 218. Each control station includes a manifold having an input and at least one output. The hydraulic line 206 may be linked to any control station, and this case the hydraulic line 206 is linked to control station 214. The control station 214 manifold receives the input from hydraulic line 206 and directs a portion of the hydraulic power provided through hydraulic line 206 to each of the other control stations 210, 212, 216, and 218. A portion of the hydraulic power is also provided to a local storage unit included within control station 214. The control station 214 in turn links the local storage unit the hydraulic lines 220 to the various hydraulic actuators that operate the blowout preventer and other gate valves on wellhead 230.

Table 1 is a comparison of the pressure drop in a first pipe having a length of 100 feet and an inner diameter of ⅜ of an inch, a second pipe having a length of 10 feet and an inner diameter of ⅜ of an inch, a third pipe having a length of 100 feet and an inner diameter of 1 inch, and a fourth pipe having a length of 10 feet and an inner diameter of 1 inch. The pressure drop through a pipe may be represented by the equation:

$$\Delta P = P_1 - P_2 = \frac{8\mu L V_{avg}}{R^2}$$

where ΔP is used to designate a pressure drop therefore $P_1-P_2$ or $\Delta P=P_1-P_2$. μ is the average dynamic viscosity of the fluid, in this case we will use the average kinematic dynamic of water at 60° F. which is 0.000021966 Ibf*s/ft$^2$. We will also set the average velocity or $V_{avg}$ at 200 ft./m or 3.33 ft./s. L is the length of the pipe in feet while R is the radius of the pipe in feet.

TABLE 1

| | | |
|---|---|---|
| 100 | 239.69 | 33.71 |
| 10 | 23.97 | 3.37 |
| L D | .03125 (.375") | .04167 (.5") |

As can be seen in table 1 the pressure drop between a 100 foot length of pipe or hose and a 10 foot length of pipe or hose is almost tenfold given the same inner diameter of the hose or pipe. In emergencies when trying to close a blowout preventer or other gate valve on a wellhead usually in excess of 100 cubic inches of hydraulic fluid at in excess of 1000 psi is required. The pressure losses associated with long hoses versus short hoses at the flow rates and pressures required makes the use of a long hose unacceptable. Generally, the red zone is in excess of 100 feet from the wellheads.

Figure 4:
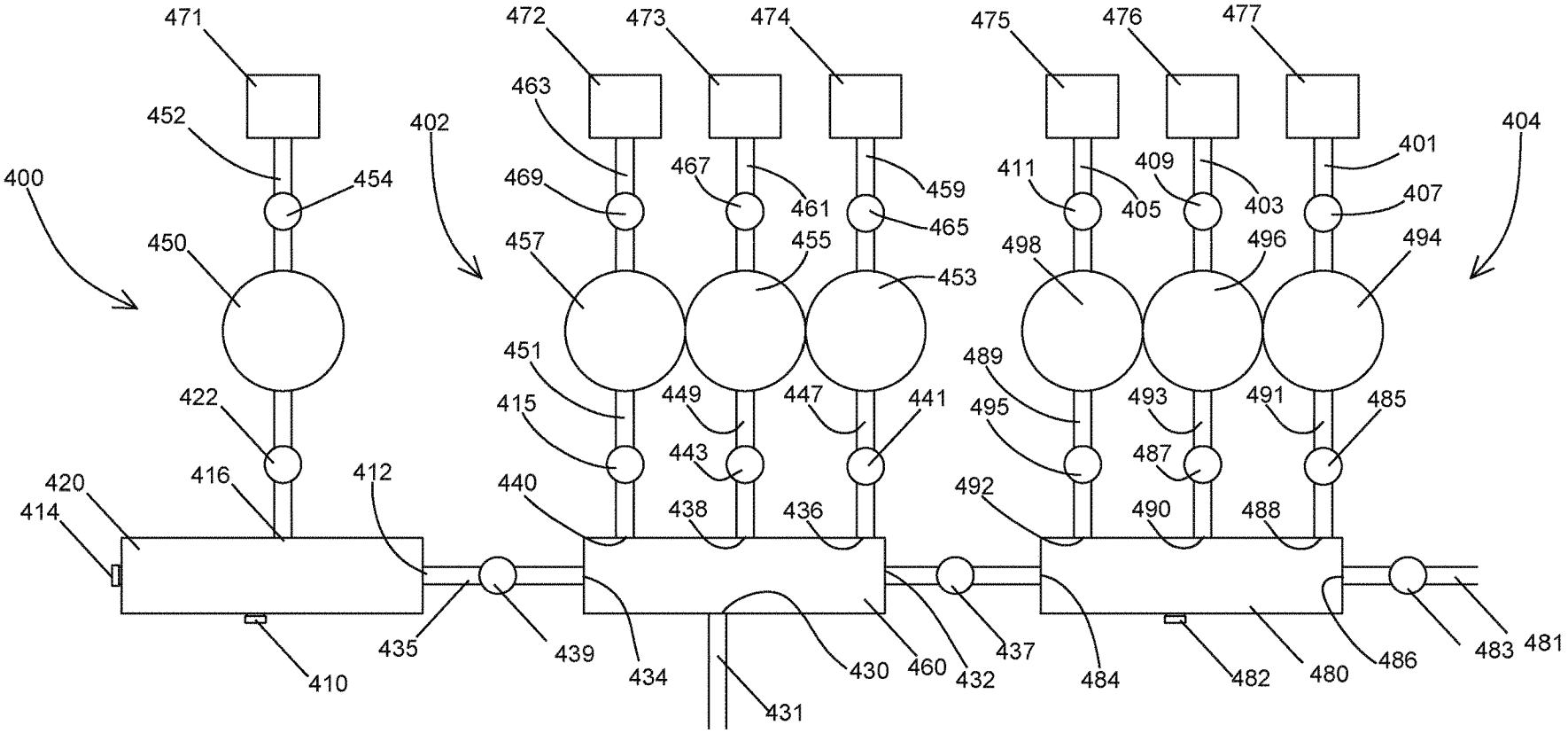
FIG. 4 is a depiction of linked control stations.

FIG. 4 is a depiction of several control stations 400, 402, and 404 of the present invention. Where control station 400 includes a manifold 420 having a first port 410, a second port 412, a third port 414, and a fourth port 416. Manifold 420 has port 410 and port 414 with a cap blocking port 410 and another cap blocking port 414. Port 412 is being utilized as an input port to supply manifold 420 with pressurized hydraulic fluid. Port 416 is being utilized as an exit port and is connected to local storage unit 450. A valve 422 is provided between local storage unit 450 and port 416. The valve 422 may be remotely operated electrically, hydraulically, or pneumatically and may also be manually operated. In this instance valve 422 is a pneumatically operated on-off valve although metering valve may be used in some instances. Local storage unit 450 is includes a fluid pathway 452, in this case a hose approximately 10 feet long and 0.375 inches in inner diameter, to a blowout preventer or gate valve on a wellhead. The fluid pathway 452 includes a valve such as valve 454. Valve 454 may be of the same type as valve 422.

Control station 402 includes a manifold 460 having a first port 430, a second port 432, a third port 434, a fourth port 436, a fifth port 438, and a sixth port 440. Port 430 is connected to hydraulic line 431 and is depicted as being utilized as an input port to supply manifold 460 with pressurized hydraulic fluid. Each of ports 432, 436, 438, 434, and 440 is depicted as being utilized as an output port. Each of ports 432 and 434 are connected to hydraulic lines 433, 435 respectively. Included in each of hydraulic line 433 and 435 may be a valve such as valve 437 and 439. Hydraulic lines 433 and 435 supply adjacent manifolds 420 and 480 with pressurized hydraulic fluid. Ports 436, 438, and 440 are each connected to hydraulic lines 447, 449, and 451. Included in each of hydraulic lines 447, 449, and 451 may be a valve such as valves 441, 443, and 445. Hydraulic lines 447, 449, and 451 supply pressurized hydraulic fluid from manifold 460 to local storage units 453, 455, and 457. Each local storage unit 453, 455, and 457 is partially filled with pressurized hydraulic fluid from each of the respective hydraulic lines 447, 449, and 451. Each local storage unit also includes an amount of pressurized gas that acts as a spring to store and release energy upon demand. Generally, the pressurized gas stores energy as pressurized hydraulic fluid is directed into each of the local storage units and the gas releases energy as pressurized hydraulic fluid is directed out of each of the local storage units. Each of the local storage units 453, 455, and 457 is connected to a hydraulic line 459, 461, and 463. The hydraulic lines 459, 461, and 463 provide a fluid pathway for the pressurized hydraulic fluid to their respective wellheads. Generally, each hydraulic line 459, 461, and 463 include a valve such as valves 465, 467, and 469. Valve 437, 439, 441, 443, 445, 465, 467, and 469 may be of the same type as valve 422.

Control station 404 includes a manifold 480 having a first port 482, a second port 484, a third port 486, a fourth port 488, a fifth port 490, and a sixth port 492. Port 482 is not utilized in this configuration and is blocked. Port 484 is connected to hydraulic line 433 and is depicted as being utilized as an input port to supply manifold 480 with pressurized hydraulic fluid from manifold 460. Each of ports 486, 488, 490, and 492 are depicted as being utilized as output ports. Port 486 is connected to hydraulic lines 481 which may provide a fluid pathway for pressurized hydraulic fluid to an adjacent manifold or an adjacent local storage unit. Included in hydraulic line 481 may be a valve such as valve 483. Ports 488, 490, and 492 are each connected to hydraulic lines 491, 493, and 489. Included in each of hydraulic lines 485, 487, and 489 may be a valve such as valves 485, 487, 495. Hydraulic lines 491, 493, and 489 supply pressurized hydraulic fluid from manifold 480 to local storage units 494, 496, and 498. Each local storage unit 494, 496, and 498 is partially filled with pressurized hydraulic fluid from each of the respective hydraulic lines 491, 493, and 489. Each local storage unit also includes an amount of pressurized gas that acts as a spring to store and release energy upon demand. Generally, the pressurized gas stores energy as pressurized hydraulic fluid is directed into each of the local storage units and the gas releases energy as pressurized hydraulic fluid is directed out of each of the local storage units. Each of the local storage units 494, 496, and 498 is connected to a hydraulic line 401, 403, and 405. The hydraulic lines 401, 403, and 405 provide a fluid pathway for the pressurized hydraulic fluid to the hydraulic valve actuators 477, 476, and 475 on their respective wellheads. Generally, each hydraulic line 401, 403, and 405 include a valve such as valves 407, 409, and 411. Valve 483, 485, 487, 495, 407, 409, and 411 may be of the same type as valve 422.

The nomenclature of leading, trailing, forward, rear, clockwise, counterclockwise, right hand, left hand, upwards, and downwards are meant only to help describe aspects of the tool that interact with other portions of the tool.

Plural instances may be provided for components, operations or structures described herein as a single instance. In general, structures and functionality presented as separate components in the exemplary configurations may be implemented as a combined structure or component. Similarly, structures and functionality presented as a single component may be implemented as separate components. These and other variations, modifications, additions, and improvements may fall within the scope of the inventive subject matter.

What is claimed is:

1. A hydraulic accumulator system comprising;

a pressurized hydraulic fluid input, a first manifold, a first fluid pathway between the first manifold and a first accumulator, a second fluid pathway between the first manifold and a second accumulator, wherein the pressurized hydraulic fluid is stored in the first accumulator and the second accumulator, wherein the first accumulator provides pressurized hydraulic fluid to only first valve actuator independently of the second accumulator providing pressurized hydraulic fluid to only the second valve actuator, a third fluid pathway between the first accumulator and the first valve actuator, a fourth fluid pathway between the second accumulator and the second valve actuator.

2. The hydraulic accumulator system of claim 1, wherein the first accumulator provides pressurized hydraulic fluid to the first valve actuator.

3. The hydraulic accumulator system of claim 1, wherein the first accumulator provides pressurized hydraulic fluid to the first valve actuator and a third valve actuator.

4. The hydraulic accumulator system of claim 1, wherein the first accumulator provides pressurized hydraulic fluid to the first valve actuator independently of providing pressurized hydraulic fluid to the third valve actuator.

5. The hydraulic accumulator system of claim 1, wherein the first fluid pathway is longer than the fourth fluid pathway.

6. The hydraulic accumulator system of claim 1, wherein the first fluid pathway is at least 100 feet in length.

7. The hydraulic accumulator system of claim 1, wherein the fourth fluid pathway is no greater than 10 feet in length.

8. The hydraulic accumulator system of claim 1, wherein an internal diameter of the first fluid pathway is greater than an internal diameter of the fourth fluid pathway.

9. The hydraulic accumulator system of claim 8, wherein the internal diameter of the first fluid pathway is at least twice the internal diameter of the fourth fluid pathway.

10. A hydraulic accumulator system comprising;

a pressurized hydraulic fluid input, at least two local accumulators, wherein each of the at least two local accumulators provide pressurized fluid to at least two valve actuators, further wherein each of the at least two local accumulators provide pressurized fluid to a single valve actuator of the at least two valve actuators, a first fluid pathway between the pressurized hydraulic fluid input, and the at least two local accumulators, at least two second fluid pathways between the at least two local accumulators and each of the at least two valve actuators, wherein the first fluid pathway is longer than the at least two second fluid pathways.

11. The hydraulic accumulator system of claim 10, wherein the first fluid pathway is at least 100 feet in length.

12. The hydraulic accumulator system of claim 10, wherein the at least two second fluid pathways are no greater than 10 feet in length.

13. The hydraulic accumulator system of claim 10, wherein an internal diameter of the first fluid pathway is greater than an internal diameter of the at least two second fluid pathways.

14. The hydraulic accumulator system of claim 13, wherein the internal diameter of the first fluid pathway is at least twice the internal diameter of the at least two second fluid pathways.

* * * * *